US007497244B2

(12) United States Patent
Hovestädt et al.

(10) Patent No.: US 7,497,244 B2
(45) Date of Patent: Mar. 3, 2009

(54) DEVICE FOR SUPPORTING AND OSCILLATING A CONTINUOUS CASTING MOLD FOR CONTINUOUSLY CASTING MOLTEN METALS, PARTICULARLY MOLTEN METAL MATERIALS, AND METHOD FOR ASSEMBLING, DIS-ASSEMBLING AND MAINTAINING THE DEVICE

(75) Inventors: Erich Hovestädt, Rhede (DE); Martin Becker, Düsseldorf (DE); Axel Weyer, Wuppertal (DE); Axel Stavenow, Düsseldorf (DE); Jörn Hoffmeister, Moers (DE)

(73) Assignee: SMS Demag AG, Düsseldorf (DE)

( * ) Notice: Subject to any disclaimer, the term of this patent is extended or adjusted under 35 U.S.C. 154(b) by 81 days.

(21) Appl. No.: 11/629,506

(22) PCT Filed: Jun. 7, 2005

(86) PCT No.: PCT/EP2005/006097

§ 371 (c)(1),
(2), (4) Date: Dec. 13, 2006

(87) PCT Pub. No.: WO2006/002732

PCT Pub. Date: Jan. 12, 2006

(65) Prior Publication Data

US 2008/0121364 A1 May 29, 2008

(30) Foreign Application Priority Data

Jul. 6, 2004 (DE) ..... 10 2004 032 764
Apr. 26, 2005 (DE) ..... 10 2005 019 295

(51) Int. Cl.
*B22D 11/053* (2006.01)

(52) U.S. Cl. ..... 164/478; 164/416

(58) Field of Classification Search ..... 164/478, 164/416

See application file for complete search history.

(56) References Cited

U.S. PATENT DOCUMENTS 6,889,748 B2 * 5/2005 Fischer et al. ..... 164/416

FOREIGN PATENT DOCUMENTS

| | | |
|---|---|---|
| CH | 377 053 | 4/1964 |
| DE | 14 33 048 | 11/1968 |
| DE | 195 41 164 | 5/1997 |
| DE | 101 31 715 | 1/2003 |
| DE | 102 44 596 | 4/2004 |
| WO | 99/62657 | 12/1999 |

* cited by examiner

*Primary Examiner*—Kuang Lin
(74) *Attorney, Agent, or Firm*—Friedrich Kueffner

(57) ABSTRACT

The invention relates to a device for supporting and oscillating a continuous casting mold (1) for continuously casting molten metals, particularly molten metal materials, comprising: guide elements (4) symmetrically arranged on both sides of the central longitudinal axis (2) of the casting; fixed supporting parts (5), and; a continuous casting mold (1) supported on paired oscillating devices (6). The inventive device facilitates the accessibility to individual modules for maintaining and/or eliminating damages. To this end, a module (7) that, itself, can be removed, is formed from paired bearing blocks (9) with guide elements (4) and with a supporting casing (7*a*) connected to said bearing blocks. The module is placed upon a stationary submodule (7*b*) and detachably connected thereto.

9 Claims, 4 Drawing Sheets

DEVICE FOR SUPPORTING AND OSCILLATING A CONTINUOUS CASTING MOLD FOR CONTINUOUSLY CASTING MOLTEN METALS, PARTICULARLY MOLTEN METAL MATERIALS, AND METHOD FOR ASSEMBLING, DIS-ASSEMBLING AND MAINTAINING THE DEVICE

BACKGROUND OF THE INVENTION

The invention concerns a device for supporting and oscillating a continuous casting mold for the continuous casting of molten metals, especially molten steels, with guide elements symmetrically arranged on both sides of the central longitudinal axis of the cast strand, stationary support members, and a continuous casting mold supported on paired oscillation devices, and a method for dismounting, mounting, and maintaining the assemblies of the device.

Continuous casting molds with cooled sidewalls that bound the mold cavity, which are surrounded by a structure that supports the sidewalls, are supported either on a mold frame or on separate, laterally arranged mounts. The mounts in turn are supported on a support construction with an oscillation device. In individual cases, the mount, the support structure, and the oscillation device form an assembly.

The mounting or dismounting of these assemblies reveals the disadvantage that all of the parts must be dismounted in each case, even though only one of these parts or assemblies is defective or in need of maintenance.

The document JP 073 28 748 A describes, for example, a mold that is supported by two lateral cantilevers on respective oscillation cylinders and guided on guide rails by lateral rollers. Molds, oscillation cylinders, and guide device are installed on a common plate, which can be dismounted.

The document DE 1 433 048 discloses a mold oscillator for molds with two mold frames installed on either side of the mold to be supported, which have mold supports and mold bearing surfaces and a common synchronized oscillation drive for the mold supports.

The document CH 377 053 A describes a mold with a mold cavity and a cooled support structure that supports the mold plates. The support structure and the mold it supports are supported on two laterally installed oscillation cylinders. At the same time, the oscillation cylinders are the supports of the mold and guide devices which act in the oscillation directions. The oscillation direction is centrally aligned with the support of the mold support structure. The oscillation cylinders are mounted on a stationary support structure. During the detachment of the support structure with the mold from the supports, the given support of the oscillation cylinder can be dismounted from or mounted on the foundation with the cylinder as a guide and the stationary support structure as an assembly.

The document DE 102 44 596 A1 discloses an installation for the continuous casting of metals, especially steels, into elongated products in a multistrand casting plant with several continuous casting molds. Each of the continuous casting molds is supported separately in an oscillating frame, which is driven to oscillate in the casting direction and is supported, for guidance and weight compensation, on a base frame by pairs of leaf springs arranged on both sides of the cast strand, which leaf springs extend transversely to the casting direction. In this regard, two housings in the form of compact flat cassettes, which are arranged one after the other in the direction of strand travel, are secured on an elongated base frame. Upper and lower pairs of leaf springs extend transversely to the cast strand in these housings. Oscillation drives act on the pairs of leaf springs, with a front oscillation drive operating synchronously with the rear oscillation drive.

SUMMARY OF THE INVENTION

Proceeding from this prior art, the objective of the invention is to refine a previously known device for supporting and oscillating a continuous casting mold and a previously known method for mounting and dismounting the device in such a way that removal of the oscillation device is simplified for devices of the aforementioned type in which the oscillation device is installed in the stationary subassembly.

This solution provides that an assembly, which can be removed by itself, consists of paired bearing blocks with guide elements and a support cassette connected with the bearing blocks and is placed on a stationary subassembly, with which it is detachably connected. The oscillation device is integrated in the stationary subassembly in a way that makes it easily accessible. This has the advantage that separate removal of the assembly is readily possible, independently of the oscillation device. This separation also takes into account the fact that the parts of the mold support plate that are subject to wear, together with the associated guide elements, must be changed more frequently than the associated oscillation device. The invention offers the advantage that dismounting or mounting of the oscillation device (valves, control devices, and hydraulic cylinders) can be carried out separately. This eliminates the necessity of dismounting the stationary support structure, the supports with the associated guide elements (such as excenters, levers, or spiral springs), and the necessity of realigning them later, as was previously necessary.

In accordance with a modification, the bearing blocks consist of single-piece wall supports, which are connected with the support cassette.

In a further refinement of this proposal, the wall support has openings for access to the side of the mold. The advantage is simple access to cooling elements of the continuous casting mold and their connections.

The proposals described above can be still further improved if the subassembly consists of an intermediate plate, a base plate, and support walls that join the two plates vertically, and if the subassembly is detachably mounted on a bearing plate by bolts.

In another embodiment, the oscillation device is installed between two support walls and below the flange plate.

In accordance with further refinements, the oscillation device, together with the piston-cylinder unit, can be taken out and later mounted again in the vertical position of the hydraulic cylinder and with the dismountable assembly removed.

It is also provided that a support plate and above that a cover plate are mounted on the support side plates. The support plate and cover plate support guide bars for the continuous casting mold. This allows reproducibly exact insertion of the continuous casting mold without realignment and/or readjustment.

In another embodiment, the extension rod attached to the piston rod passes through the support plate and is detachably connected with the continuous casting mold.

In addition, the previously stated objective of the invention is achieved by the claimed method. The advantages of this method are the same as the advantages mentioned above in connection with the claimed device.

This method can be further developed in such a way that, after the dismounting of the assembly consisting of paired bearing blocks with guide elements and a support cassette connected with the bearing blocks, the oscillation device is held in its mounted and operative functional position, and the remaining maintenance work is performed without detaching a hydraulic connection. The separation into an assembly comprising support members/guide elements and an assembly comprising the oscillation device makes it possible to dismount the assembly comprising the support members/guide elements by itself, such that this step of the method is carried out without opening the hydraulic circuit of the oscillation device. An important advantage of the separate assemblies is the avoidance of contamination of the hydraulic circuit by an unnecessary change of the oscillation device.

Specific embodiments of the invention are illustrated in the drawings and described in greater detail below.

DETAILED DESCRIPTION OF THE DRAWING

Figure 1:
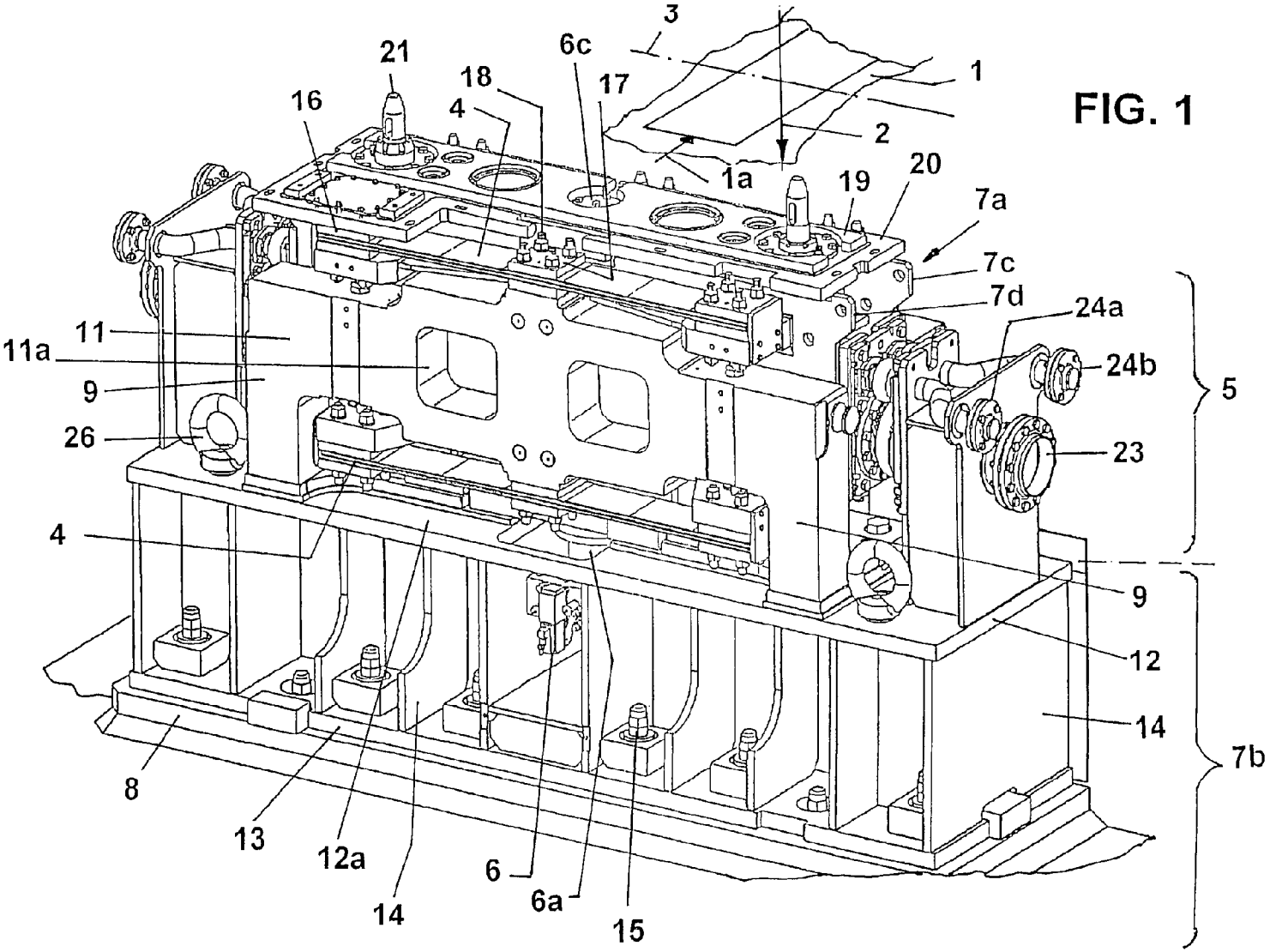
FIG. 1 shows a perspective view of a support structure installed on both sides of the cast strand opening in the casting platform.

The device for supporting and oscillating a continuous casting mold 1 is provided preferably for slab strands consisting of molten steels, and the cast strand is withdrawn in the direction of the central longitudinal axis 2 of the cast strand. The assembly illustrated in FIG. 1 is used on both sides of the plane of symmetry 3. The largely self-supporting continuous casting mold 1 is supported and moved by guide elements 4. The guide elements 4 can comprise excenters, steering levers, springs of any type or, as illustrated, leaf springs. The use of leaf spring assemblies is assumed in the specific embodiment illustrated here. The weight of the continuous casting mold 1 with the molten cast material or the developing cast strand can be supported by means of stationary support members 5 and pairs of oscillation devices 6. The support members 5 form an assembly 7 that can be removed by itself and is detachably connected indirectly with a bearing plate 8 that is stationary on the casting platform. The support members 5 or the assembly 7 has bearing blocks 9, on which the guide elements 4 (here the leaf spring assemblies) are mounted. In the embodiment illustrated in FIG. 1, the guide elements 4 are secured by means of clamping plates 16 both on the outside ends and in the center 17 of the length with bolts 18 arranged at the corners of squares. In this regard, the bearing blocks 9 each form part of a continuous (single-piece) wall support 11, which is supported and secured on an intermediate plate 12. The wall support 11 has openings 11*a* for access to elements of the mold cooling system or the mold mounting in the direction of the side 1*a* of the mold. In the specific embodiment shown here (FIG. 1), a free space 12*a* for lower guide elements 4 is additionally present in the wall support 11. The intermediate plate 12, together with a base plate 13 and several horizontally spaced support walls 14, forms another subassembly 7*b*.

Figure 3:
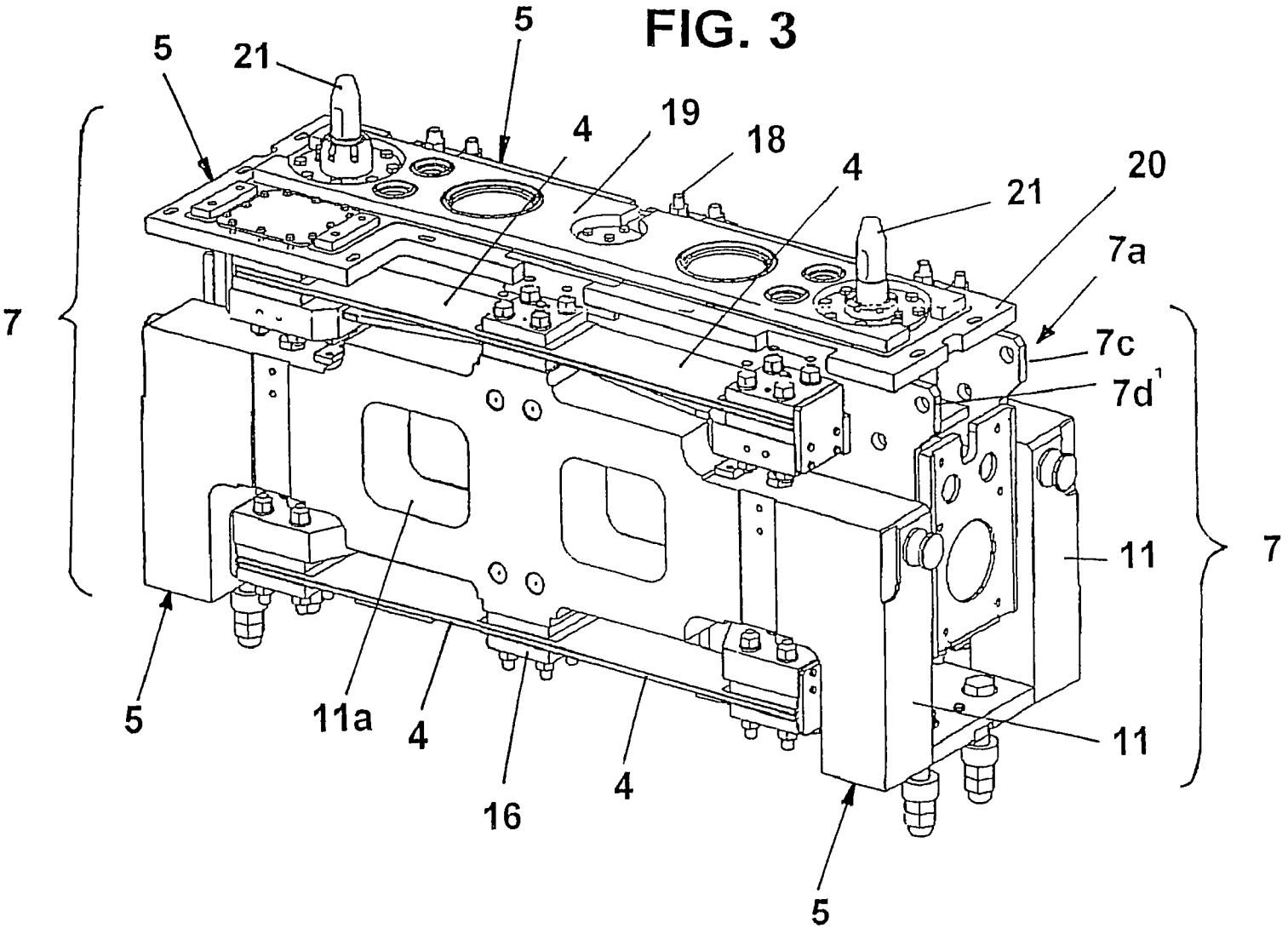
FIG. 3 shows a perspective view of the assembly that can be dismounted by itself.

This results in an assembly 7 (FIG. 3), which consists of bearing blocks 9 or a pair of wall supports 11, one or more clamping plates 16, and guide elements 4, such that the assembly 7 is detachably mounted on the intermediate plate 12 by bolts.

Figure 2:
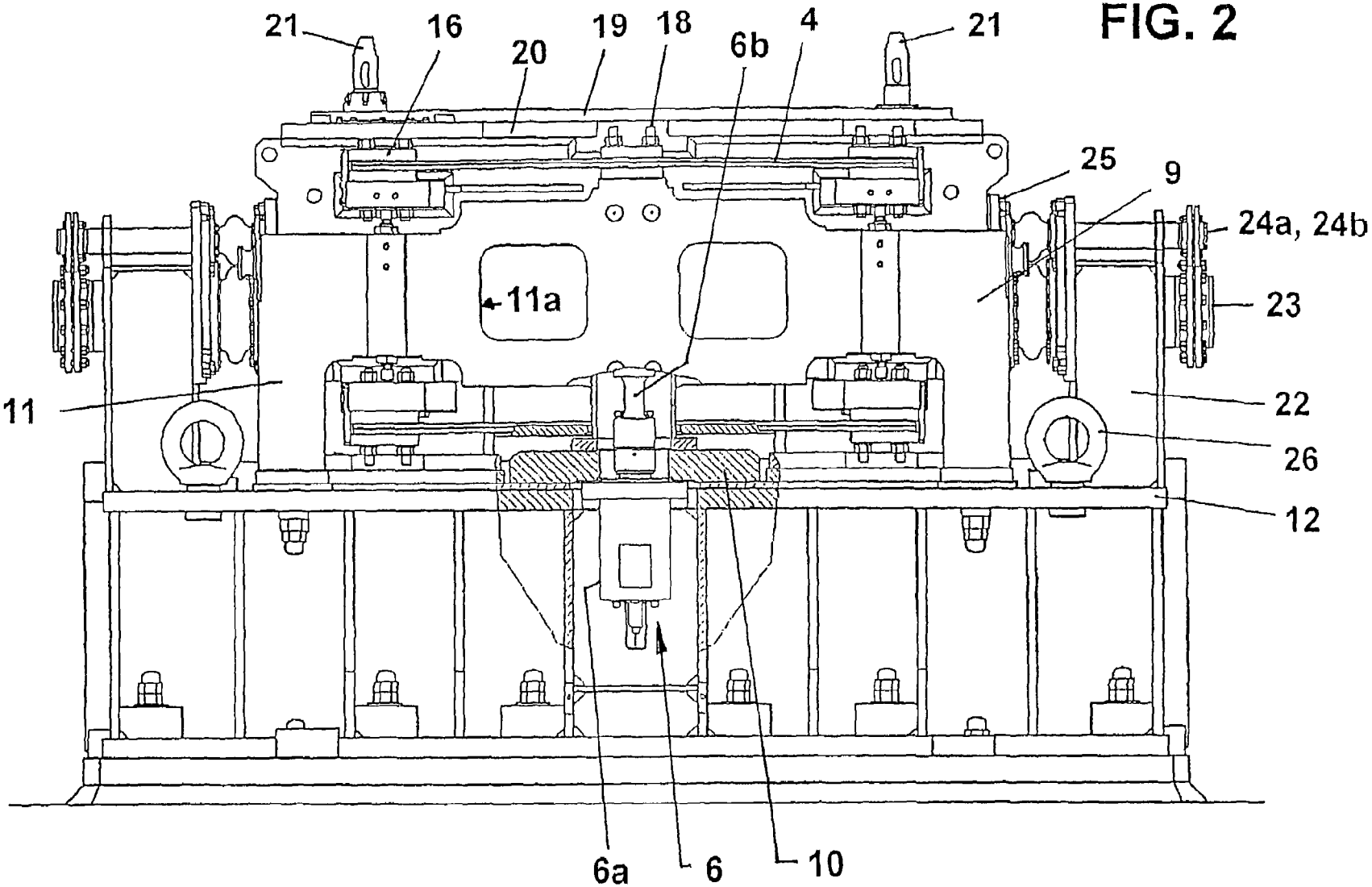
FIG. 2 shows the same view as FIG. 1 in a vertical front elevation.

The oscillation device 6 is installed in a protected position within the stationary subassembly 7*b* and is connected to a hydraulic circuit. The oscillation device 6 is installed between two support walls 14 in the lower region on a flange plate 10 (FIG. 2). The piston-cylinder unit 6*a* passes through the entire assembly 7 (FIG. 3), and its piston rod 6*b* carries an extension rod 6*c*. The latter is surrounded by a protective tube 6*d*. The extension rod 6*c* is detachably connected (FIG. 4) with the support cassette 7*a*. In this regard, the oscillation device 6 can be removed towards the top from the stationary subassembly 7*b* by means of the flange plate 10, but this is only rarely necessary.

A support plate 20 and above that a cover plate 19 are mounted on the support side plates 7*c*, 7*d*. The cover plate 19 has guide bars 21 for the continuous casting mold 1 for reproducibly exact mounting of the continuous casting mold 1.

The extension rod 6*c* connected to the piston rod 6*b* passes through the support plate 20 and is detachably connected with the continuous casting mold 1 via the support cassette 7*a*.

The continuous casting mold 1 is set down by crane on a support plate 20, which is located above a cover plate 19 with the guide bars 21.

Part of the support members 5 is also a mounting structure 22 (FIGS. 1, 2, and 4) for a cooling water connection 23 (feed flow) and for cooling water connections 24*a*, 24*b* (return flow), which lead to a water connection plate 25.

The support members 5 are lifted out as assembly 7 by means of a crane during dismounting and inserted by means of a crane during mounting.

The extent of assembly 7 can vary within certain limits from case to case, provided only that the condition of quick, easy, time-saving changing of the support members 5 and the guide elements 4 is met when they must be serviced or changed due to wear.

Figure 4:
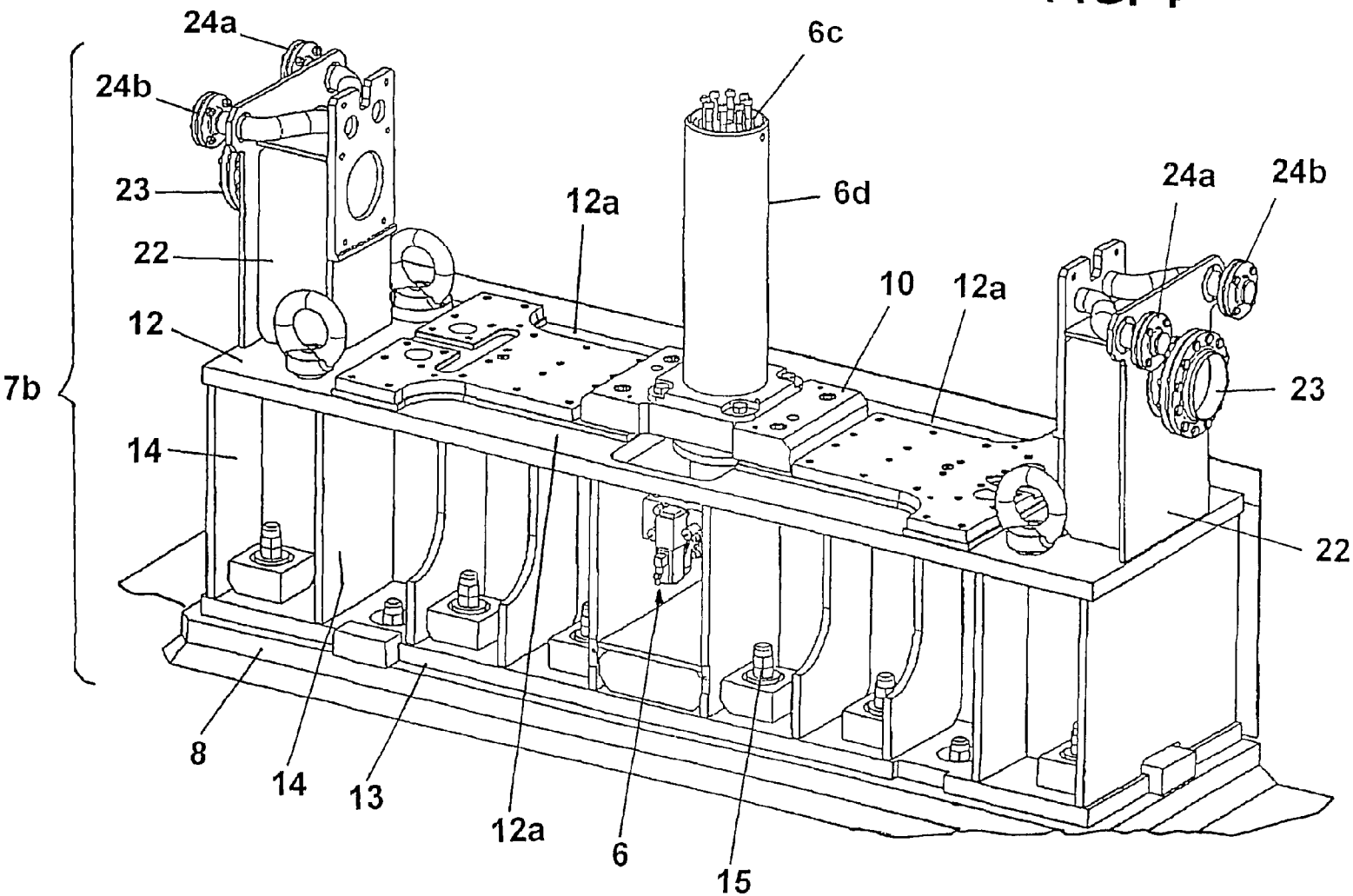
FIG. 4 shows detail of the stationary support structure of the subassembly.

FIG. 4 shows subassembly 7*b* with assembly 7 completely removed, i.e., with, among other things, the guide elements 4 and the clamping plates 16, the bolts 18, the single-piece wall support 11 with the bearing blocks 9, the cover plate 19, and the support plate 20 with the guide bars 21 dismounted. As FIG. 4 further shows, easy access to the oscillation device 6 with the piston-cylinder units 6*a* is also possible now. The piston-cylinder units 6*a* can be removed towards the top and can be mounted again in the opposite direction.

FIGS. 1 to 4 thus show and describe a method for mounting or dismounting a device for oscillating a continuous casting mold 1 for molten metals, especially molten steels, wherein, in a dismounting step, an assembly, which can be removed by itself, is first removed, and then, if necessary, the respective oscillation device 6 can be removed towards the top, if this is necessary, and the opposite procedure is followed during mounting.

This method for mounting, dismounting, or maintaining a device for oscillating a continuous casting mold 1 for molten metals, especially molten steels, can be carried out in such a way that, after the dismounting of assembly 7 comprising paired bearing blocks 9 with guide elements 4 and a support cassette 7*a* connected with the bearing blocks 9, the oscillation device 6 is held in its mounted and operative functional position, and the remaining maintenance work is performed without detaching a hydraulic connection. The very important condition that contamination of the hydraulic circuit must be avoided is thus fulfilled.

LIST OF REFERENCE NUMBERS

1 continuous casting mold
1*a* side of the mold
2 central longitudinal axis of the cast strand
3 plane of symmetry
4 guide elements
5 support members
6 oscillation device
6*a* piston-cylinder unit
6*b* piston rod
6*c* extension rod
6*d* protective tube
7 assembly that can be removed by itself
7*a* support cassette
7*b* subassembly
7*c* support side plate
7*d* support side plate
8 bearing plate
9 bearing blocks
10 flange plate
11 single-piece wall support
11*a* opening
12 intermediate plate
12*a* free space
13 base plate
14 support wall
15 base bolts
16 clamping plate
17 center of the length
18 bolts
19 cover plate
20 support plate
21 guide bar
22 mounting structure
23 cooling water connection, feed flow
24*a* cooling water connection, return flow
24*b* cooling water connection, return flow
25 water connection plate
26 lifting eyebolt

The invention claimed is:

1. A device for supporting and oscillating a continuous casting mold (1) for the continuous casting of molten metals, with an assembly (7), which is symmetrically arranged on both sides of the central longitudinal axis (2) of the cast strand and comprises paired bearing blocks (9) with guide elements (4) and a support cassette (7*a*) connected with the bearing blocks (9), for supporting the continuous casting mold;

a stationary subassembly (7*b*), on which the assembly (7) is placed; and an oscillation device (6) with a hydraulic piston-cylinder unit (6*a*) that has a piston rod (6*b*) and is connected to a hydraulic circuit;

where the assembly (7) is detachably connected with the subassembly (7*b*); and where the oscillation device (6) is installed within the stationary subassembly (7*b*); wherein the piston rod (6*b*) is provided with an extension rod (6*c*), which is surrounded by a protective tube (6*d*) and is detachably connected with the support cassette (7*a*); and where the extension rod (6*c*), the protective tube (6*d*) and the oscillation device (6) are mounted on the stationary subassembly (7*b*) by means of a flange plate (10) in such a way that they can be removed towards the top.

2. A device in accordance with claim 1, wherein the bearing blocks (9) consist of single-piece wall supports (11), which are connected with the support cassette (7*a*).

3. A device in accordance with claim 1, wherein the wall support (11) has openings (11*a*) for access to the side (1*a*) of the mold.

4. A device in accordance with claim 1, wherein the subassembly (7*b*) consists of an intermediate plate (12), a base plate (13), and support walls (14) that join the two plates vertically and where the subassembly (7*b*) is detachably mounted on a bearing plate (8) by bolts (15).

5. A device in accordance with claim 4, wherein the oscillation device (6) is installed between two support walls (14) and below the flange plate (10).

6. A device in accordance with claim 1, wherein a support plate (20) and above that a cover plate (19) are mounted on the support side plates (7*c*, 7*d*), and that the support plate (20) and the cover plate (19) support guide bars (21) for the continuous casting mold (1).

7. A device in accordance with claim 1, wherein the extension rod (6*c*) attached to the piston rod (6*b*) passes through the support plate (20) and is detachably connected with the continuous casting mold (1).

8. A method for mounting or dismounting a device in accordance with claim 1 for supporting and oscillating a continuous casting mold (1) for molten metals, including the steps of: arranging an assembly (7) symmetrically on both sides of the central longitudinal axis (2) of the cast strand, for supporting the continuous casting mold; detachably placing the assembly (7) on a stationary subassembly (7*b*); and installing an oscillation device (6), within the stationary subassembly (7*b*), the oscillation device having a hydraulic piston-cylinder unit (6*a*) that is connected to a hydraulic circuit and has a piston rod (6*b*);

in a dismounting step, removing the assembly (7) by itself, and then, optionally removing the oscillation device (6), together with an extension rod (6*c*) for the piston rod and with a protective tube (6*d*) that surrounds the extension rod, from the subassembly (7*b*) towards the top, and the opposite procedure being followed during a mounting operation.

9. A method in accordance with claim 8, wherein, after the assembly (7) dismounting step and determining removal of the oscillation device is unnecessary, performing the remaining maintenance work on the device without detaching a hydraulic connection to the device without detaching a hydraulic connection to the oscillation device.

* * * * *